US008460483B2

(12) United States Patent
Yajima et al.

(10) Patent No.: US 8,460,483 B2
(45) Date of Patent: Jun. 11, 2013

(54) METHOD FOR HEAT TREATMENT OF COILED SPRING

(75) Inventors: Takashi Yajima, Yokohama (JP); Hideki Okada, Yokohama (JP); Katsuyuki Nishioka, Yokohama (JP); Takeshi Furuse, Yokohama (JP)

(73) Assignee: NHK Spring Co., Ltd., Yokohama-Shi (JP)

( * ) Notice: Subject to any disclaimer, the term of this patent is extended or adjusted under 35 U.S.C. 154(b) by 16 days.

(21) Appl. No.: 13/052,522

(22) Filed: Mar. 21, 2011

(65) Prior Publication Data

US 2011/0232810 A1 Sep. 29, 2011

(30) Foreign Application Priority Data

Mar. 23, 2010 (JP) ..... 2010-065765

(51) Int. Cl.
*C21D 9/02* (2006.01)
*C21D 8/02* (2006.01)

(52) U.S. Cl.
USPC ..... 148/580; 148/566; 148/567; 148/575

(58) Field of Classification Search
USPC ..... 148/580, 566–576
See application file for complete search history.

(56) References Cited

U.S. PATENT DOCUMENTS

| | | | | |
|---|---|---|---|---|
| 2,261,878 | A * | 11/1941 | Hathaway | 148/576 |
| 4,336,081 | A | 6/1982 | Hijikata et al. | |
| 4,407,683 | A | 10/1983 | Hijikata et al. | |

FOREIGN PATENT DOCUMENTS

| | | | |
|---|---|---|---|
| JP | A-55-31109 | | 3/1980 |
| JP | 55-91947 | * | 7/1980 |
| JP | A-58-213825 | | 12/1983 |
| JP | A-64-23524 | | 1/1989 |

OTHER PUBLICATIONS

English abstract of Chinese patent 101543947 A, Liu et al., Sep. 30, 2009.*

English-hand translation of Japanese patent 55-91947, Morita J., Jul. 11, 1980.*

Suspension Spring Working Group, Research Committee on Durability Ofhigh-Strength Steel Wire, "Study on Oil-Tempered Chromium-Silicon-Alloy High-Strength Steel Wire for Suspension Springs," 1994, pp. 101-130, vol. 39.

* cited by examiner

*Primary Examiner* — Deborah Yee
(74) *Attorney, Agent, or Firm* — Oliff and Berridge, PLC

(57) ABSTRACT

A method for heat treatment of a coiled spring includes cold forming a coiled spring, annealing the coiled spring after the cold forming, thereby removing of residual stress generated in the cold forming, in which the annealing is performed by electric resistance heating.

4 Claims, 3 Drawing Sheets

METHOD FOR HEAT TREATMENT OF COILED SPRING

BACKGROUND OF THE INVENTION

1. Field of the Invention

The present invention relates to a method for heat treatment of coiled springs obtained by cold forming, and in particular relates to an improvement in annealing performed after the cold forming.

2. Related Art

In some kinds of producing methods for a coiled suspension spring used in automobiles, a working method by hot forming or cold forming is used. In the working method by hot forming, a linear wire rod is heated to a temperature of 800° C. or more and is formed into a coiled spring. Then, heat treatment such as quenching and tempering is performed. In the working method by the cold forming, a linear wire rod that was heat-treated in a way such as quenching and tempering (a heat-treated material such as an oil-tempered steel wire) is formed into a coiled shape at ordinary temperature, thereby yielding a coiled spring.

In the working method by cold forming a heat-treated material, since the linear wire rod is formed into a coiled shape, when load is removed after forming, the tensile residual stress remains in the inner portion (the portion facing the axial center) of the coiled spring, and compressive residual stress remain in the outer portion (the portion facing the reverse side of the axial center). These residual stresses largely degrade durability of the coiled spring. Therefore, the stresses are removed after forming the coiled spring by low temperature annealing in a gas furnace or an electric furnace, in which an atmosphere is maintained within a temperature range of 350 to 500° C.

For example, Japanese Patent Application, First Publication No. 55-31109 discloses a method in which low temperature annealing in an atmosphere furnace is performed by applying an oil-tempered Si—Cr steel wire as a heat-treated material. According to the above technique, the average value of the residual stress in portions from the surface to 1 millimeter depth of the oil-tempered steel wire is reduced according to the time for the heat treatment in the furnace. If the time for the heat treatment is more than 30 minutes, the average value of the residual stress hardly varies. For example, Japanese Patent Application, First Publication No. 1-23524 discloses a method in which a linear wire rod is quenched and tempered, and is formed by cold forming into a coiled spring, then stress is removed by annealing. In the above technique, the quenching and the tempering of the linear wire rod before the cold forming are performed by electric resistance heating or induction heating, and the annealing after the forming is performed for a long time in an atmosphere furnace.

In a coiled spring, durability with respect to repeated load is improved according to increase of hardness of the wire rod. Recently, there is great demand for lightweight coiled springs. Therefore, a wire rod that is hard and has great tensile strength is used as a heat-treated material for cold forming, whereby the coiled spring can be used under high stress.

However, when a linear heat-treated material is formed into a coiled spring by cold forming, and the tensile strength of the heat-treated material is large, the residual stress is also large compared to a case in which the tensile strength is low, so that, as is explained in the above, durability of the coiled spring may be degraded.

According to the conventional techniques applied in annealing in an atmosphere furnace, the temperature in the furnace must be raised and the coiled spring must be soaked for a long time to remove the increased stress thereof. However, in the above case, a hardness of the coiled spring is reduced by raising the temperature in the furnace and soaking at high temperature for a long time, and therefore, the amount of the residual stress to be removed must be determined in consideration of balance with respect to the hardness of the wire rod in order to improve the durability of the coiled spring. As a result, the performance of the wire rod cannot be sufficiently functioned.

According to the annealing performed in a conventional atmosphere furnace, since annealing in the furnace requires a long time in a case in which a batch-type atmosphere furnace is used, although heat loss is reduced and energy efficiency can be improved by improvement of air-tightness in the furnace, productivity is reduced. On the other hand, if an open-type furnace for passing through materials is used, although productivity can be improved, the furnace must be made larger and cannot hold the seal because the materials must be transported in and out in heating, whereby heat loss is increased and energy efficiency is deteriorated.

Furthermore, in the beginning of the operation of a furnace, the material cannot be transported into the furnace until the temperature in the furnace is stably maintained at a predetermined temperature, because problems of quality of the product come up. Therefore, the furnace must be heated without the materials inside, so that energy efficiency is greatly deteriorated in a case in which the batch amount is small.

SUMMARY OF THE INVENTION

Therefore, an object of the present invention is to provide a method for heat treatment of coiled spring in which annealing for removing residual stress generated in forming the coiled spring obtained by cold forming can be performed without decrease of energy efficiency, productivity, and quality of products.

According to the method for heat treatment of coiled spring of the present invention, the method includes cold forming for the coiled spring, annealing the coiled spring after the cold forming, thereby removing residual stress in the cold forming thereof, in which the annealing is performed by electric resistance heating.

According to the method for heat treatment of coiled spring of the present invention, the coiled spring obtained by the cold forming is annealed by electric resistance heating, so that the annealing can be performed in a short time (for example, 10 seconds to about 1 minute) compared to a case in which a conventional furnace is used. Therefore, in the coiled spring annealed by the electric resistance heating compared to the case in which a conventional furnace is used, when residual stress of the coiled spring after the annealing is set at the same degree as that of the coiled spring obtained by the conventional furnace, since the hardness of the coiled spring is reduced, even if the coiled spring is used in a condition in which high stress is applied, durability of the coiled spring can be reliably improved. When the coiled spring is heated to a temperature so that the coiled spring has the same hardness as that of the coiled spring processed by the conventional furnace, residual stress of the coiled spring can be less and durability of the coiled spring is further improved.

Furthermore, in the electric resistance heating, since the coiled spring is internally heated by directly conducting electric current, the temperature of the atmosphere in the apparatus need not be raised, so that high energy efficiency can be obtained. Since the temperature of the atmosphere therein need not be raised, energy efficiency does not depend on the batch amount of products of the coiled spring. Furthermore, the annealing can be performed in a much shorter time, whereby high productivity can be obtained and the structure of the apparatus for annealing may be made simple. In the furnace, the problems caused by, for example, long time for heating, maintaining air-tightness, and heating without batches of materials can be avoided by electric resistance heating, whereby further improvements of the energy efficiency in producing, productivity, and quality of the product can be obtained.

The method for heat treatment of the coiled spring of the present invention can be applied with variations of the heat treatment. For example, in the annealing, the coiled spring is heated to a predetermined temperature and cooled without maintaining the coiled spring at the predetermined temperature. The annealing is preferably performed at a temperature of 360 to 500° C. Furthermore, the coiled spring after the annealing, for example, can be rapidly cooled.

According to the method for the heat treatment of the coiled spring of the present invention, the coiled spring obtained by cold forming is annealed by electric resistance heating, so that annealing can be performed in a short time compared to a case in which a conventional furnace is used.

DESCRIPTION OF THE PREFERRED EMBODIMENTS

Figure 1:
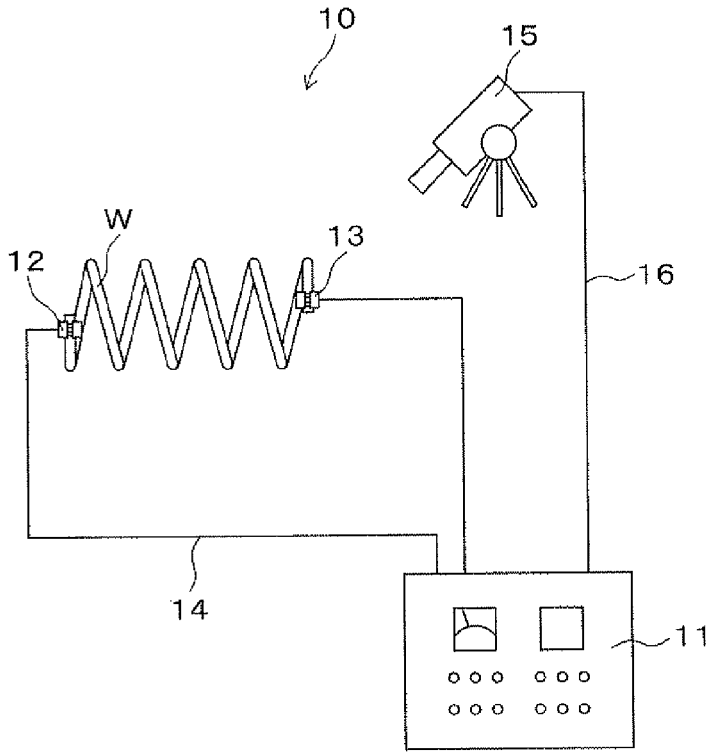
FIG. 1 is a diagrammatic view of an apparatus used in a method for heat treatment of a coiled spring in accordance with an embodiment of the present invention.

An embodiment of the present invention is explained hereinafter with reference to the drawings. FIG. 1 is a diagrammatic view of an electric resistance heating apparatus 10 used in a method for heat treatment of coiled spring W in accordance with an embodiment of the present invention. The heat treatment performed in an electric resistance heating apparatus 10 is, for example, stress removing annealing. The electric resistance heating apparatus 10 is provided with electrodes 12 and 13 for conducting electric current to the coiled spring W. The electrodes 12 and 13 are connected to an electric power supply 11 for the electric resistance heating via a cable 14 for conducting electric current. The electric power supply 11 for electric resistance heating is connected to a radiation thermometer 15 for measuring the temperature of the coiled spring W via a thermo signal cable 16. As a means for measuring the temperature of the coiled spring W, an apparatus such as a thermography or a contact-type thermometer may be applied instead of the radiation thermometer 15.

The coiled spring W is connected to the electrodes 12 and 13 in a condition in which the unconnected portion is insulated from the other parts of the electric resistance heating apparatus 10. The direction in which the coiled spring W is disposed is not particularly restricted, and it may be in the lengthwise direction or the crosswise direction. For controlling deformation at the minimum of the coiled spring W caused by weight thereof and removing stress, a fixing jig for preventing deformation thereof may be additionally used. In both end portions of the coiled spring W not contacting the electrodes 12 and 13, the temperature may not be sufficiently raised, whereby sufficient effects by annealing and tempering may not be obtained. However, both end portions of the coiled spring W closely contact counter parts and stress in compressing is small compared to other portions of the coiled spring. Therefore, even if residual stress at both end portions is large compared to the other portions, there will be no problem.

Figure 2:
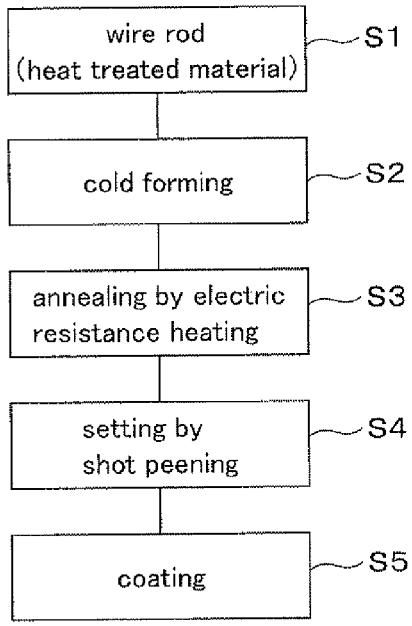
FIG. 2 is a flow chart showing a process of a producing method for a coiled spring applying the method for heat treatment of a coiled spring in accordance with the embodiment of the present invention.

A producing method for the coiled spring W to which was applied the heat treatment of the present embodiment is explained hereinafter referring to FIG. 2. First, a linear wire rod (a heat-treated material, such as an oil tempered steel wire) heat-treated in such as a way as quenching and tempering, is prepared (step S1) and is coiled by cold forming. Thus, a coiled spring W is obtained (step S2). In the above steps, since the linear wire rod is formed into the coiled spring W, if the load is removed after the forming, tensile residual stress remains at the inner portion (the portion facing the axial center) of the coiled spring W, and compressive residual stress remains in the outer portion (the portion facing the reverse side of the axial center) of the coiled spring W.

Next, the coiled spring W is annealed by electric resistance heating. The electric resistance heating is conducted, for example, for 10 to 20 seconds so that the temperature of the coiled spring W is maintained at a temperature of 360 to 500° C. In the annealing, as shown in FIG. 1, the coiled spring W is fixed by the electrodes 12 and 13 and an electric current from the electric power supply 11 for electric resistance heating is applied. In this case, when the temperature of the coiled spring W which is measured by the radiation thermometer 15 is raised to a predetermined temperature, applying the electric current from the electric power supply 11 for the electric resistance heating is forcibly suspended.

By the annealing applied with the above electric resistance heating, residual stress generated in the cold forming is removed from the coiled spring W. In this case, the coiled spring W is cooled without maintaining at a predetermined temperature after heating to a predetermined temperature in the annealing, so that residual stress and the hardness of the coiled spring W can be stable. The cooling is preferably performed by rapid cooling such as by using water cooling or forced-air cooling. Then, the coiled spring W is painted (step S5) after setting by shot peening (the step 4), and thus, a product of the coiled spring W can be obtained.

According to the present embodiment, the coiled spring W obtained by the cold forming is annealed by the electric resistance heating, so that the annealing can be performed in a short time (for example, in 10 seconds to about 1 minute) compared to a case in which a conventional furnace is used. Therefore, in the coiled spring W annealed by the electric resistance heating compared to a case in which a conventional furnace is used, when residual stress of the coiled spring W after annealing is set at the same degree as that of the coiled spring obtained by the conventional furnace, since the hardness of the coiled spring W is reduced, even if the coiled spring W is used in a condition in which high stress is applied, durability of the coiled spring W can be reliably improved. When the coiled spring W is heated to a temperature so that the coiled spring has the same hardness as that of the coiled spring processed by the conventional furnace, residual stress of the coiled spring W can be less and durability of the coiled spring W is further improved.

Furthermore, in electric resistance heating, since the coiled spring W is internally heated by directly conducting electric current, the temperature of the atmosphere in the apparatus need not be raised, so that high energy efficiency can be obtained. Since the temperature of the atmosphere therein need not be raised, energy efficiency does not depend on batch amount of products of the coiled springs W. Furthermore, annealing can be performed in a much shorter time, so that high productivity can be obtained and the structure of the apparatus for annealing may be simple. In the atmosphere furnace, a problem caused by, for example, long time for heating, maintaining air-tightness, and heating without batch materials can be avoided by the electric resistance heating, whereby further improvements of energy efficiency in producing, productivity and quality of the product can be obtained.

In a case in which an article having a curved surface shape such as the coiled spring W is heated by electric resistance, the inner (the central side) portion is supplied with more electric current than the outer (the reverse side of the center) portion, whereby the temperature is higher than that of the outer portion, and therefore, the hardness of the inner portion of the coiled spring W may be decreased. In annealing by electric resistance heating, the temperature of electric resistance heating is very low and electric resistance heating can be performed in a very short time, whereby the difference between the temperatures of the inner and outer portions is not so large, so that the difference of the hardness between the inner and the outer portions is not a problem. As a result, the hardness of the coiled spring W can be stable.

An embodiment of the present invention is explained in detail referring to the specific examples hereinafter. In the examples, a coiled spring (having a diameter of 10.8 mm) formed by cold forming a wire rod as a heat-treated material was annealed under various conditions, and the examples were obtained.

Examples 11 to 13, 21 to 23 and 31 to 33 of the present invention were obtained such that coiled springs were annealed by electric resistance heating at heating temperatures and for heating times shown in Table 1, and the coiled springs were cooled without maintaining at the heating temperatures. It should be noted that the time described in the column "cooling method" in Table 1 is a time from the completion of annealing until the beginning of the cooling by water cooling. Comparative Example 11 was obtained such that a coiled spring was annealed in an atmosphere furnace instead of the annealing by the electric resistance heating. Other conditions for Comparative Example 11 were the same as those of the examples of the present invention. The conditions of the annealing and the cooling are shown in Table 1. As show in Table 1, Comparative Example 21 was a coiled spring obtained by coiling as cold forming (hereinafter referred to as "cold coiled spring") and was not annealed.

The coiled springs in Examples 11 to 13, 21 to 23, and 31 to 33 of the present invention and Comparative Examples 11 and 21 were obtained by the above method, and the hardness and the residual stresses of the inner portion (the portion facing to the axial center) of the coiled springs were measured. The results of the measuring is shown in Table 1 and FIGS. 3 and 4. It should be noted that the hardness was measured by Rockwell C-scale hardness at the position of ½ R (R is a diameter of the wire rod) from the circumferential surface of the coiled spring. "Inner axis" shown in FIGS. 3 and 4 means the portion facing to the axis (that is, the inner side) of the coiled spring. The coiled springs of Example 22 and Comparative Example 11 were subjected to endurance test in air. The results of the test are shown in FIG. 5. The average main stress was set at 735 MPa.

TABLE 1

Figure 3:
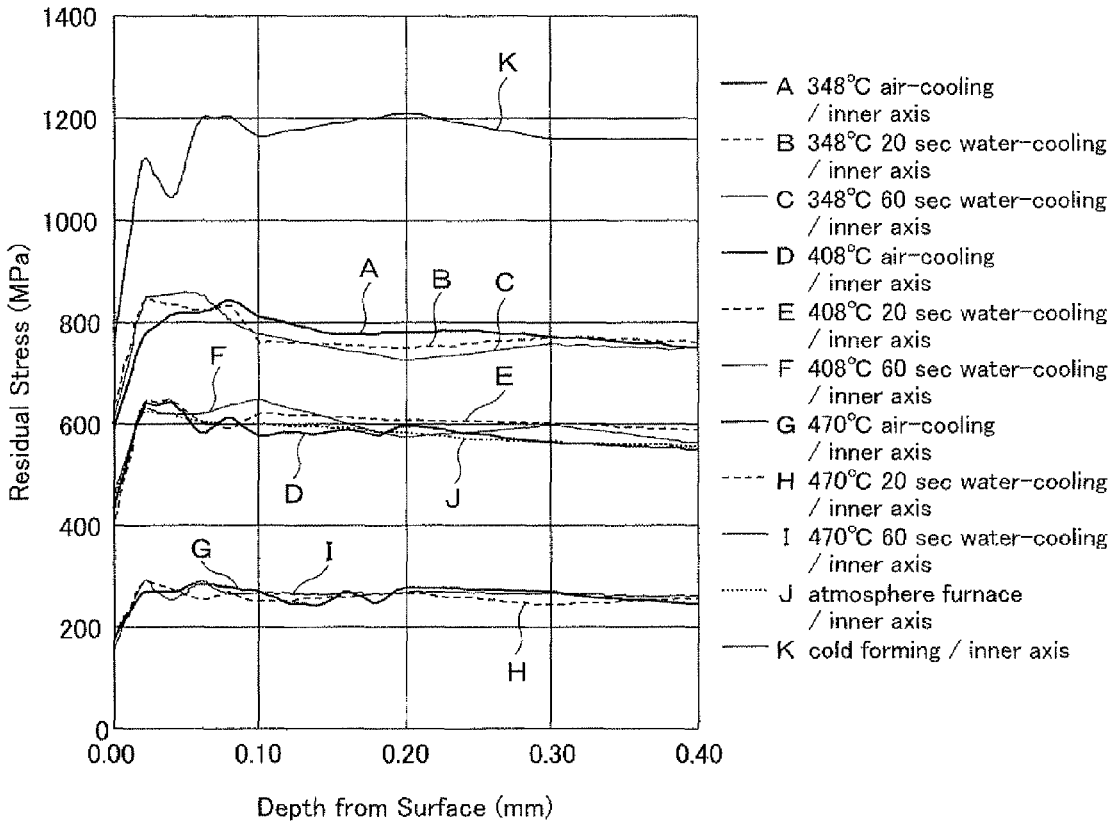
FIG. 3 is a graph showing a relationship between depth from a surface of an Example and residual stress thereof after annealing in accordance with an Example of the present invention.
Figure 4:
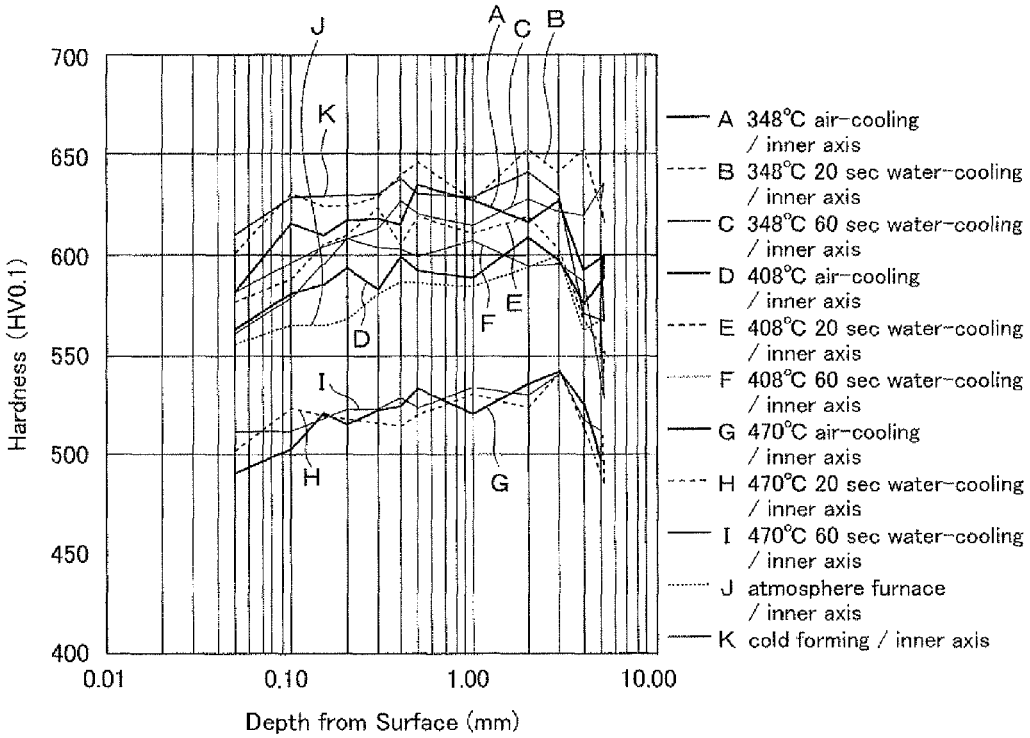
FIG. 4 is a graph showing a relationship between the depth from the surface of the sample and hardness thereof after annealing in accordance with an Example of the present invention.
Figure 5:
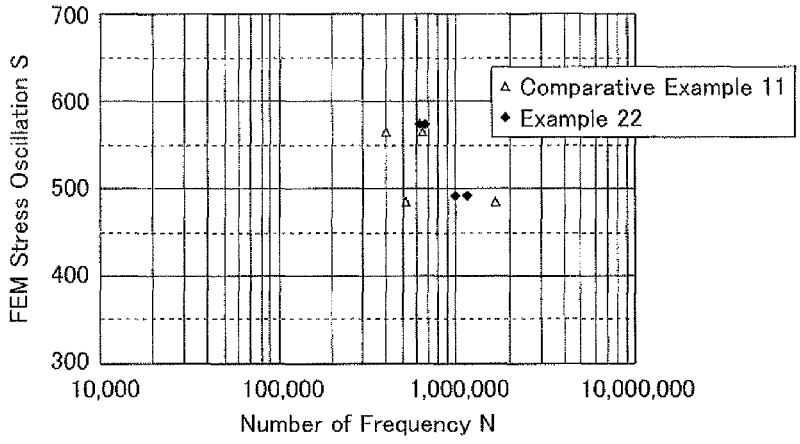
FIG. 5 is a graph showing a result of an endurance test of the samples after annealing in accordance with an Example of the present invention.

| | Annealing Method | Heating Temperature ° C. | Heating Time | Cooling Method | Hardness HRC | Data in FIGS. 3 and 4 |
|---|---|---|---|---|---|---|
| Example 11 | Electric Resistance heating | 348 | 10 sec | Air Cooling | 55.3 | A |
| Example 12 | Electric Resistance Heating | | | Water Cooling 20 sec after | 55.4 | B |
| Example 13 | Electric Resistance Heating | | | Water Cooling 60 sec after | 55.6 | C |
| Example 21 | Electric Resistance Heating | 408 | 12 sec | Air Cooling | 53.2 | D |
| Example 22 | Electric Resistance Heating | | | Water Cooling 20 sec after | 53.9 | E |
| Example 23 | Electric Resistance heating | | | Water Cooling 60 sec after | 54 | F |
| Example 31 | Electric Resistance Heating | 470 | 14 sec | Air Cooling | 50.1 | G |
| Example 32 | Electric Resistance Heating | | | Water Cooling 20 sec after | 50.4 | H |
| Example 33 | Electric Resistance Heating | | | Water Cooling 60 sec after | 50 | I |
| Comparative Example 11 | Atmosphere Furnace | 380 | 40 min | Air Cooling | 52.4 | J |
| Comparative Example 21 | — | — | — | — | 53.3 | K |

In the coiled springs of the Examples 11 to 13, 21 to 23, and 31 to 33 of the present invention annealed by the electric resistance heating, as shown in FIG. 3 and as is understood by comparison with Comparative Example 21 which was the cold coiled spring, the residual stresses were removed from the inner portions, and as shown in Table 1 and FIG. 4, the hardness of each was substantially the same as that of Comparative Example 21 which is the cold coiled spring and Comparative Example 11 which was annealed in the atmosphere furnace. According to the above result, it was confirmed that the residual stress of the coiled spring could be reduced by annealing used with electric resistance heating, and the hardness thereof could be avoided from being decreased.

As shown in Table 1 and FIGS. 3 and 4, in the coiled springs of Examples 11 to 13, 21 to 23, and 31 to 33 of the present invention, the residual stress and the hardness varied according to the heating conditions (the temperature and the time of heating). However, as is understood by comparison between Examples 11 to 13, between Examples 21 to 23 and between Examples 31 to 33, the residual stress and the hardness did not vary according to the time from the completion of the heating until the beginning of the cooling. Therefore, it was confirmed that if cooling was rapidly performed after the heating in which the coiled spring was not easily affected by the atmosphere, reducing of the residual stress and the improvement of the hardness of the coiled spring were not affected by the above conditions, and the quality of the coiled spring could be stable.

The coiled springs of Examples 11 to 13 of the present invention which were annealed by the electric resistance heating at a temperature of 348° C. had high hardness compared to Comparative Example 11 annealed in the atmosphere furnace; however, the residual stresses thereof were not sufficiently removed therefrom. As characteristics of the coiled spring, balance between the residual stress and the hardness affect the durability of the coiled spring, the characteristics of the coiled springs of Examples 11 to 13 of the present invention were insufficient, even if the superior hardness compared to that of Comparative Example 21 was considered. Therefore, the temperature of the annealing by the electric resistance heating is preferably set at 360° C. or more.

As shown in FIG. 3, the coiled springs of Examples 21 to 23 of the present invention which were annealed by electric resistance heating at a temperature of 408° C. had residual stresses which were substantially the same as that of Comparative Example 11 annealed in the atmosphere furnace. As shown in Table 1, the coiled springs of Examples 21 to 23 of the present invention which were annealed by the electric resistance heating at a temperature of 408° C. had the hardness of which was 1 to 1.5 HRC higher than that of Comparative Example 11 annealed in the atmosphere furnace. In the coiled springs of Examples 21 to 23 of the present invention which were annealed by the electric resistance heating at a temperature of 408° C., it was confirmed that the hardness thereof was superior compared to that of Comparative Example 11 annealed in the atmosphere furnace.

As shown in FIG. 5, in the coiled spring of Example 22 of the present invention which were annealed by the electric resistance heating at a temperature of 408° C., it was confirmed that the durability was stable in a high stress condition, and durability thereof could be greatly improved compared to the coiled spring of Comparative Example 11. As a result, in the coiled spring which was annealed by the electric resistance heating, it is understood that durability thereof could be greatly improved.

What is claimed is:

1. A method for heat treatment of a coiled spring, comprising:

cold forming a coiled spring;

annealing the coiled spring after the cold forming; and removing residual stress generated in the cold forming;

wherein the annealing is performed by electric resistance heating for a time period of 10 seconds to 1 minute, in the annealing, after the coiled spring is heated to a temperature of 360° C. to 500° C., applying an electric current for the electric resistance heating is suspended, and the coiled spring is cooled without maintaining the coiled spring at the temperature.

2. The method for heat treatment of a coiled spring according to claim 1, wherein rapid cooling is performed after the annealing.

3. The method for heat treatment of a coiled spring according to claim 2, wherein the rapid cooling is performed by water cooling or forced-air cooling.

4. The method for heat treatment of a coiled spring according to claim 1, wherein the removal of residual stresses is balanced with a variation in hardness.

* * * * *